United States Patent [19]

Crowe

[11] Patent Number: 4,541,586

[45] Date of Patent: Sep. 17, 1985

[54] ROPE REEL DISPLAY AND DISPENSER ASSEMBLY FOR PERFORATED PANEL BOARDS

[76] Inventor: Byron A. Crowe, c/o Crowe Rope Company, Warren, Me. 04864

[21] Appl. No.: 571,438

[22] Filed: Jan. 17, 1984

[51] Int. Cl.[4] ..... B65H 49/00; D01H 7/16

[52] U.S. Cl. ..... 242/129.5; 242/129.8; 242/55.3

[58] Field of Search ..... 242/55.2, 55.3, 55.53, 242/129.5, 129.51, 129.53, 129.8; 248/216.1, 216.4, 217.1–218.2, 200.3, 220.4, 221.1; 211/120, 123; 225/46, 47

[56] References Cited

U.S. PATENT DOCUMENTS

| | | | |
|---|---|---|---|
| 1,646,313 | 10/1927 | Perry et al. | 242/55.3 |
| 2,518,328 | 8/1950 | Janonis | 242/55.2 |
| 3,072,351 | 1/1963 | Connolley | 242/55.3 |
| 3,337,157 | 8/1967 | Plog | 242/129.8 |
| 4,218,028 | 8/1980 | Pickens | 242/55.2 |

FOREIGN PATENT DOCUMENTS

| | | | |
|---|---|---|---|
| 963877 | 3/1975 | Canada | 242/55.2 |

*Primary Examiner*—Leonard D. Christian
*Attorney, Agent, or Firm*—Laforest S. Saulsbury

[57] ABSTRACT

A rope reel display and dispensing assembly for perforated panel boards often referred to as Pegboards in which reels of ropes, wire, cable, chains, tubing, hose products can be dispensed in measured continuous lengths and which are supported in rows upon the panel board in such a manner that reels are individually removable without disturbing any of the other reels of the row. All reels are connected to rod brackets, projecting forwardly from the panel board, by rod extending adapters that are in turn respectively snap-fitted to the forward-extending rod brackets and to which reel adapters that will have been inserted respectively in the respective opposite ends of the reels and will slide fit down upon the rod adapters and be removable with the reel from the extended axial-aligned assembly of reels.

3 Claims, 9 Drawing Figures

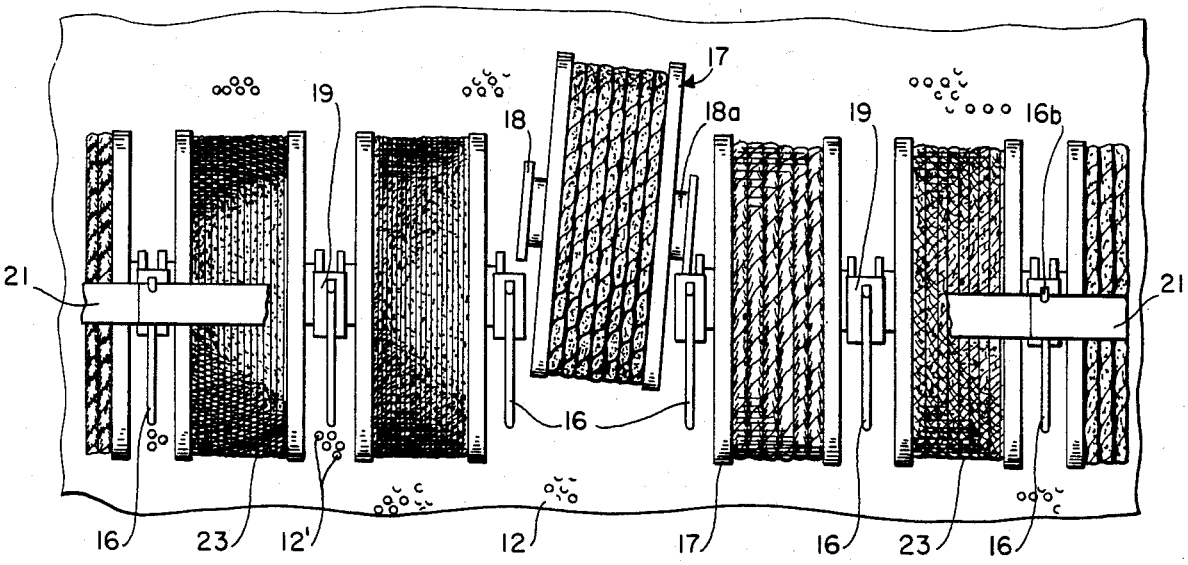
Fig. 4
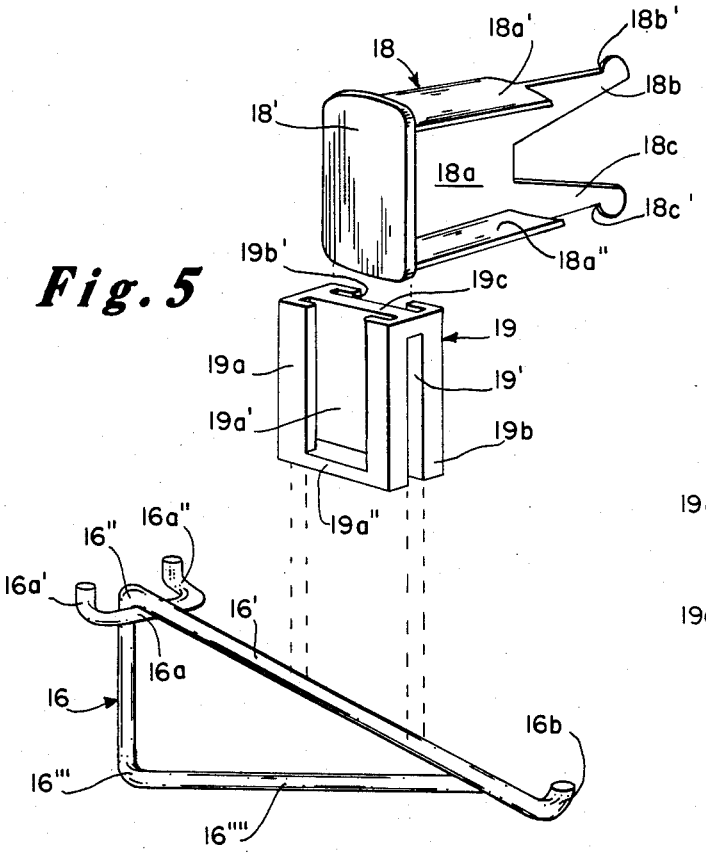
Fig. 5
Fig. 9
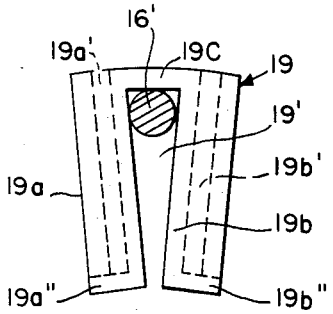

ROPE REEL DISPLAY AND DISPENSER ASSEMBLY FOR PERFORATED PANEL BOARDS

This invention relates to a rope reel display and dispensing assembly and more particularly to means for detachably supporting the rope reels to the perforated panel boards, one independently of the other.

Heretofore, rope reels or spools containers for continuously dispensed rope, wire or cable have been supported in mulitple fashion on a support rack as by gathering several reels or spools on long cross rods and laying the ends of the rod upon widely spaced elevated brackets projecting forwardly from the front of the rack. When it becomes necessary to remove or replace a reel or spool, the rod with the several reels or spools had to be lifted from the forwardly projecting support brackets and reels had to be removed from the rod in order to get at such empty reel disposed inwardly of the end reels, the end reels had first to be removed, thereby consuming much time to make the change. Such reels or spools made of plywood or cardboard have not been adapted for easy individual assembly upon a perforated panel board in a group and for individual removal of one from the other.

It is, therefore, the principal object of the present invention to provide a rope reel or spool assembly for perforated panel boards by which several reels will be disposed in axial alignment with one another across the panel boards and in such a way as to permit the individual removal or replacement of one reel without having to disturb the other reels of their axial alignment in the assembly.

It is another object of the invention to provide a rope reel or spool display and dispenser assembly with the reels in axial alignment with one another, in which, adjacent reels will have a common support projecting forwardly from the perforated panel board and so that one reel of the common support can be removed without interfering with the mounting of the other reel thereupon.

It is another object of the invention to provide a rope reel display and dispensing assembly with adapters for connecting the reels in axial alignment with one another and to forwardly projecting rod brackets on the perforated panel board, in which the adapters for the reels are mountable upon the reel with sufficient looseness and movement that the adapters upon the mounting of the reel upon and its removal from the rod bracket will be facilitated by free play in the reel.

It is still another object of the invention to provide a rope reel display and dispensing assembly in which the adapters will be loosely snap-fitted into the reel but held against easy axial displacement therefrom and in which the rod adapters also will be snap-fitted and frictionally retained upon the rod brackets, against easy axial and rotational displacement.

It is still another object of the invention to provide a rope reel display and dispensing assembly for the independent removal of reels on which a reel card designating the linear contents of the individual reel, may be carried upon the outer ends of the rod brackets ahead of the reels and free thereof without interfering with the removal or replacement of the reel and its linear contents thereof.

It is a further object of the invention to provide a perforated panel board reel display and dispenser assembly in the rod and reel adapters that will be made of plastic so as to be easily fitted with one another and with different color plastic will make the overall appearance of the panel board display of rope and reels more attractive and pleasing than possible with plywood and cardboard reels.

Still further objects of the invention are to provide a perforate panel board reel display and dispenser assembly with the above objects in mind, which is simple in construction, inexpensive to manufacture, easy to assemble, strong, durable, and efficient in use.

For a better understanding of the invention, reference may be had to the following description taken in connection with the accompanying drawing, in which;

FIG. 4 is a fragmentary frontal view of a transverse row of axially-aligned reels mounted upon the perforated panel board and an illustration being made as to the manner in which one reel is individually removed without disturbing the other reels of the row.

FIG. 5 is an exploded perspective view of the interconnecting rod bracket and adapter free of the panel board, of one another and of the reel and in vertical alignment preparatory for assembly upon one another.

FIG. 9 is an end view of the expansible rod adapter deplacement, partly unsprung as when free of the rod bracket and yet fully mounted thereupon.

Figure 1:
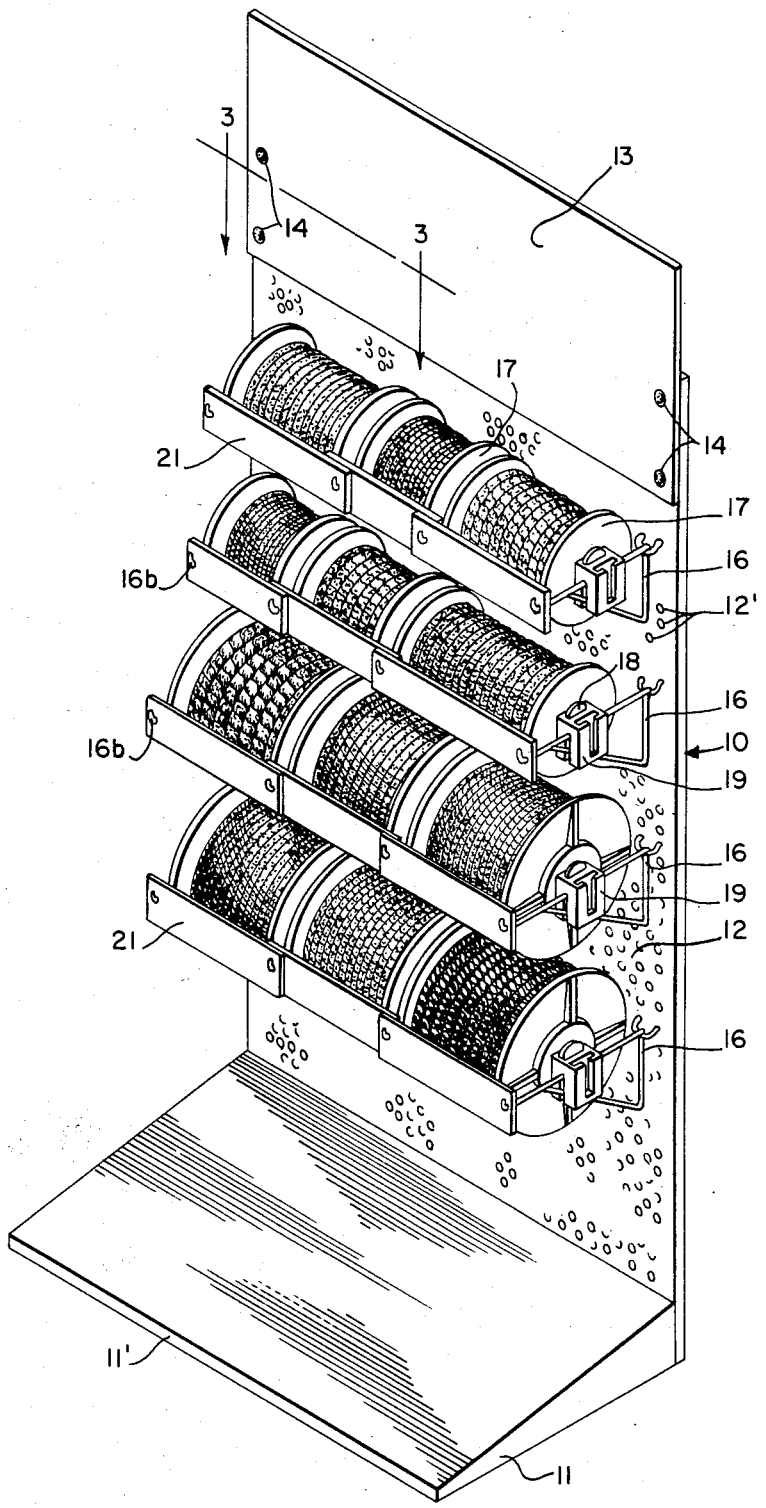
FIG. 1 is a front perspective view of a perforated panel board with rows of rope reels assembled thereon by the use of the brackets and adapters of the present invention.

Referring now to the Figures, there is shown a perforated panel board support for rope reels indicated generally at 10 comprising a floor base 11 from the rear edge of which there is secured a vertically-extended perforate panel board 12. The top face of the base 11 inclines downwardly and forwardly to its forward edge 11 and a data plate 13 extends across the front of the panel board at its upper end and secured by attaching screws 14 thereto. This perforated panel board 12 has the usual equally horizontally and vertically spaced peg holes 12' throughout its full area. Rod brackets 16 are detachably mounted in the usual manner by insertion of their ends in peg holes 12' for the support of reels or spools 17 containing rope or cable to be dispensed therefrom. To mount these reels 17, reel adapters 18 are extended or thrust into the end member **17*a* and 17*b* of the reel, one at each end thereof, and the reel and these adapters slide-fitted into rod brackets 16 forwardly projecting from the perforated panel board 12. All reels 17 will be axially-aligned within their rows such that the reels are each individually removable from one another, without disturbing the other reels in a row in a manner as will become more apparent as this description proceeds. On a single perforated panel board several rows of rope reels 17** can be disposed, one row above the other. These reels can contain a variety of different ropes varying in size and color. With the reels and adapters being formed of plastic of different colors, it makes for an overall display of rope of much pleasing appearance.

In this display of FIG. 1, there are four rows of rope reels having different size plastic ropes and that may be each of different color of themselves. The reels 17 are formed of plastic as well as the ropes and they may be of standard of different colors according to rows within the rows. The rod brackets 16 are formed of three-sixteenth inch diameter metal rod bent into the desired shape as best seen in FIG. 5, and is the only metal used with this panel board 10 except for the screws therein. The panel board 12 itself is of the usual fibreboard or plywood and its base 11 preferably is of wood or some suitable weightly material. However, even this panel board and its support may also be made of colorful plastic material.

Plastic data cards 21 are detachably hung from the outer ends of the forwardly-projecting rod brackets free of the reels so that the reels need not be removed to read about their contents and so that data cards will not interfere with the removal of the reels of the rows.

The rod bracket 16 as best seen in FIG. 4 has a horizontal portion 16' leading from a bend 16'' of a depending portion 16''' from lower end of which an inclined brace portion 16'''' forwardly extends to unite with the outer end of horizontal portion 16'. Extending transversely under the rod bend 16'', is a U-shaped rod piece 16 which is welded thereto and it legs are turned up at **16*a*' and 16*a*'' to hook in spaced peg holes 12' of the panel board 12, whereby the bracket 16 will be suspended from the panel board with engagement of its vertical portion 16'''** with the face thereof and thereby held against lateral and vertical displacement therefrom.

Figure 2:
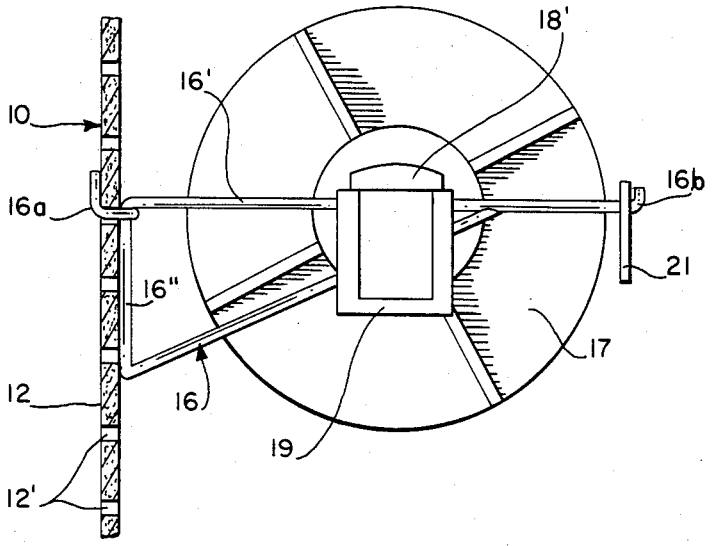
FIG. 2 is an enlarged end view of one reel and of its assembly on the panel board and looking in elevation upon the joined adapters and the rod bracket as viewed along line 2—2 of FIG. 3.

The horizontal portion 16' has a turned up outer end **16*b* to accomodate holes in the ends of data cards 21. Joined ends of data cards 21 can both be hung from one turned up end 16*b* of one rod bracket 16, see FIGS. 1, 2 and 3**.

The rod brackets 16 will have first been mounted on the panel board in the manner above described and spaced from one another depending upon the axial length of the reels 17 to be displayed. These same reels can contain rope, wire, cable, chains, tubing, hose or like products of continuous length that is normally dispensed and sold from a reel or spool.

Once the brackets 16 have been assembled upon the perforated panel board at the selected spacing for the different length reels 17, the rod adapter 19, normally closed and tapered, as viewed in FIG. 9, is forced down over the horizontal rod portion 16' of the bracket 16. This plastic adapter is formed of molded plastic and has grooved leg portions **19*a* and 19*b* joined together at their upper ends by a transverse portion 19*c* to provide an expansible middle slot 19'. As the adapter 19 is forced down the horizontal portion 16' of the rod bracket 16, the grooved leg portions 19*a* and 19*b* are spread from their closing position to admit the horizontally-extending rod portion 16' into the middle slot 19' of the adapter 19 and frictionally retained in a tight-fitting manner against axial and rotational displacement thereon. The grooved leg portions 19*a* and 19*b* are biased to close the middle slot 19' and are sprung only for their mounting upon the rod bracket 16 and their removal. The transverse portion 19*c* rests upon the rod bracket horizontal portion 16' in the assembled position of the adapter upon the rod bracket, see FIG. 9. Once the adapter 19 is adjusted to its position upon the rod bracket, it is relatively rigid for the mounting of the reel thereto and frictionally retained against axial and rotational displacement. The transverse portion 19*c* has sufficient resiliency to allow the separation of the grooved leg portions 19*a* and 19*b* of the adapter 19 to open slot 19' and to close the grooved portions about the rod portion 16'. The adapter 19 is thus held upon the rod portion 16''** so that it cannot walk on the rod bracket and will interlock the reels thereagainst.

Figure 3:
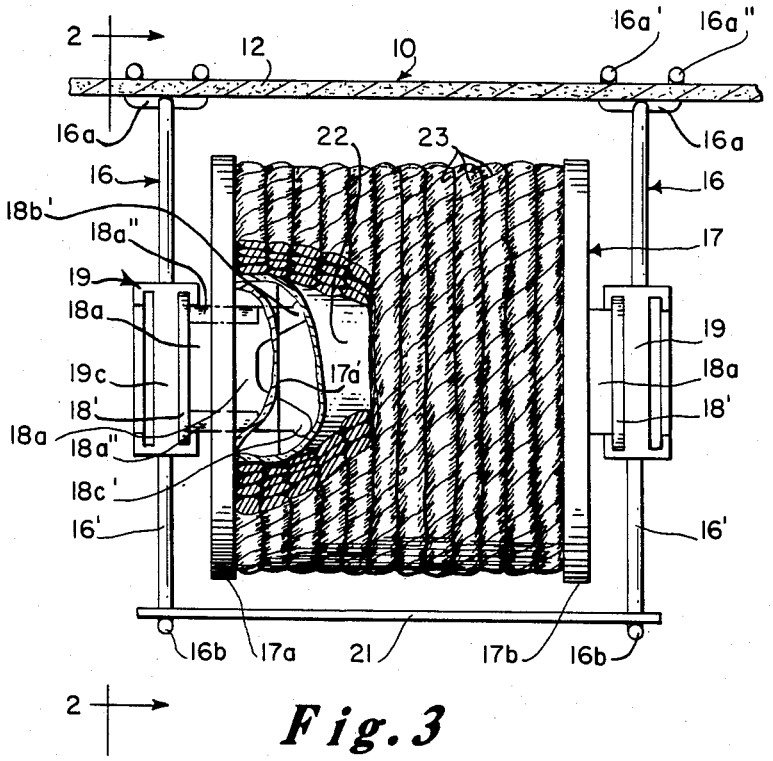
FIG. 3 is a top plan view of an individual row reel assembly with one portion of the rope reel being broken away to show the interior of the reel and the connection of a reel adapter to the end member of the reel, the view being generally taken on line 3—3 of FIG. 1.

The adapter grooved leg portions **19*a* and 19*b* have respectively open face wide shallow grooves 19*a*' and 19*b*' depending from the transverse portion 19*c* to accomodate enlarged flange head portion 18' of the reel adatper 18. These grooves are closed respectively at their botton ends at 19'' and 19*b*'' to support the reel adapters 19 and reel 17 upon the rod adapter 19 on the rod brackets 16. The flanged head portion 18' of the reel adapter 18 is integrally formed with thin sheet-like shank portion 18*a* that extends laterally therfrom for insertion into end members 17*a* and 17*b* of the reel 17. The free end of shank portion 18*a* terminates with bifurcated end portions 18*b*' and 18*c*' that are enlarged radially at their tip ends as indicated at 18*a* and 18*b*' to spring over radially-extended inner shoulder 17*a*' of reel end members 17*a* and 17*b* of the reel 17 and thereby prevent easy axial displacement of the adapters 18 from the reel 17 once they have been assembled thereto and yet have free rotation for the reels. The shank portion 18*a* of the reel adapter 18 is elongated and of over length to allow some free axial displacement while in place so that the adapter 18 can move in and out of the reel as is needed in order to be accomodated by the relatively fixed adapters 19 on the rod brackets and to their spacings on the panel board 12. As seen in FIG. 3, the end members 17*a* and 17*b* of the reel 17 are joined by a tight fitting paperboard central sleeve 22 fitted over the outer cylindrical surface of the reel end member 17*a*, the outer end of the sleeve 22 lying between the end members 17*a* and 17*b*** with rope thereon to be dispensed therefrom. This rope can be of colored plastic and of different size.

The shank portion **18*a* of adapter 18 has rounded side edge portions 18'' over its edges to provide wide bearing surfaces for engagement with the surface of the central opening in the reel end member 17 and to allow smooth rotational movement of the adapter 18** therewithin.

Once the reel adapter 18 is thrust into and assembled upon the reel so that the shank tip ends **18*b*' and 18*c*' over run the shoulder 17*a*' of the reel end member, the length and diameter of the shank portion 18*a* is such as to allow both free axial and rotational movement of the adapter to facilitate the connection of these reel adapters and reel with the rod adapter. With this freedom of loose movement of the adapter in the reel end member, the connection of the reels by their adapters to the relatively rigid rod adapter 19 on the rod brackets is easily made. This is necessary for the efficient handling of the individual reel to take it out of a row of axially-aligned reels held on the panel board. The manner of assembly of the individual reel is best illustrated in FIG. 4. The replacement of a new reel is effected when the reel has been depleted of its rope or when a switching of the reels may be desired. Each reel while in axial alignment with one another is individually mounted between two brackets coupled to the panel board. The reels will ordinarily have different size and color ropes 23 that will be identified by data cards 21 detachabley mounted upon the rod ends 16***b* of the brackets 16. Once the loose adapters 18 of the reels are grooved with the rod adapters 19 these adapters 18 become rigid with adapters with no looseness or play between them but the reels 17 will freely rotate on adapter shanks 18*a*.

Figure 6:
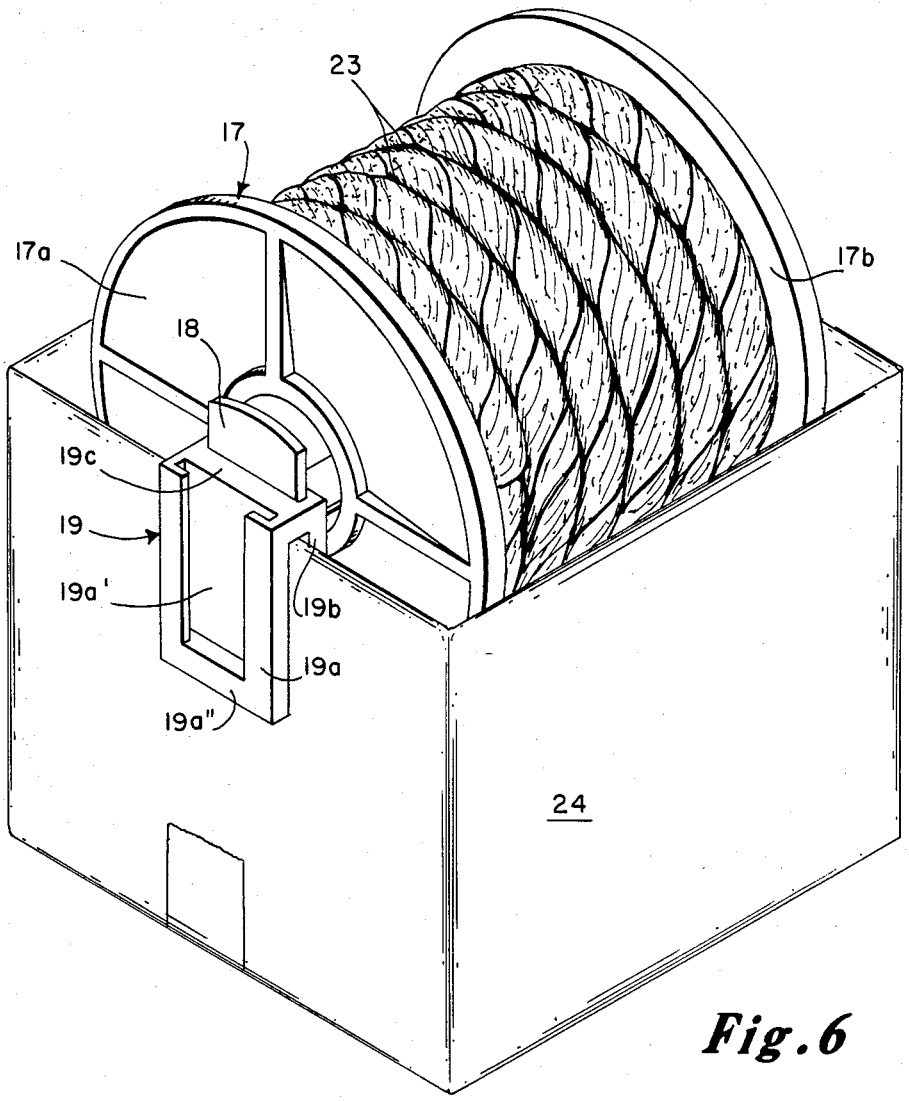
FIG. 6 is a perspective view of a rope reel detachably mounted by use of the adapters of this invention, upon the top side edges of a carton in which the reel was shipped.
Figure 7:
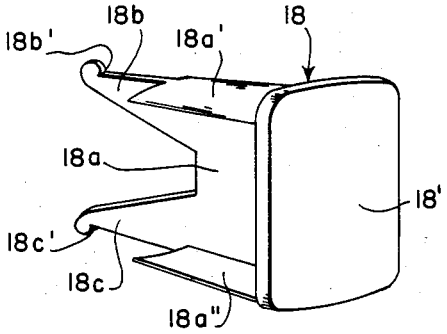
FIG. 7 is a front perspective view of the plastic rope reel snap-on adapter that is extended into the end member of the reel and to which the reels are journaled to dispense the rope.
Figure 8:
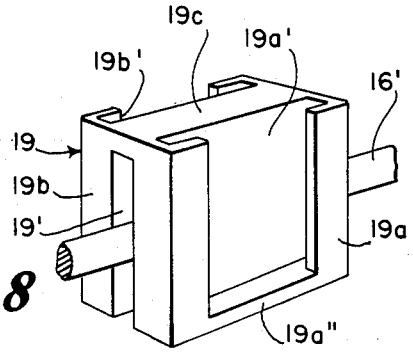
FIG. 8 is an end perspective view of the rod adapter that has been forced downwardly over the horizontal portion of the forwardly-projecting rod bracket to be frictionally retained thereon against easy axial and rotational displacement.

As seen in FIG. 6, these same adapters 18 and 19 can be similarly mounted over the side edges of a box or carton 24 to support any rope reel 17 that has been shipped in the carton for the purposes of displaying and dispensing its rope 23. The rope 23 is easily extended from the reel 17 and cut off at the desired length. The expansible adapters 19 can thus be clipped to box side as well as to rod bracket 16 and be rigidly retained thereover. Since the reel that came in the carton is substantially the same length as the carton, the adapters on the sides of the carton will be properly spaced to accomodate the reel. The spacing between supporting brackets 16 on the panel board is determined by the width of the reel to be displayed.

It should now be seen that the assembling of the rod brackets, adapters and reels, is a simple procedure. First, the rod brackets 16 are placed upon the panel board. Second, the groove adapters 19 are forced upon the brackets 16. Third, the adapters 18 are fitted into the end reels 17. Then, the mounting of the reel and its adapters 18 is effected onto the mounted rod brackets 16 with the slide fitting of the reel adapter 18 into the groove of the rod adapter 19. The adapters 19 and 18 become then a rigid combination on which the reel 17 can freely rotate. The flanged head 18' of the reel adapter 18 fits tightly in the side groove of the bracket adapter 19 to solidify in effect the reel adapter upon the rod adapter. The closed bottom of the rod adapter grooves at 19*a*'' keep the reel adapters 18 from dropping through the grooves. The reel 17 is thus held in a position between the rod brackets 16 and is free to rotate and dispense the linear product.

The exact distance between rod brackets 16 on the panel board 12 need not be made since the reel or spindle adapter 18 for the reels 17 allow an axial play of some one half inch for each adapter, limited only from the engagement of the tip ends of the adapters shank 18*a* with the inner shoulder of the reel end member. The rod bracket adapter 19 serves by the use of its opposing grooves as a common support for two reels, one on each side thereof.

This rope display and dispenser can be made in various sizes and configurations and still employ the basic design of permitting individual assembly of one reel of a row of multiple reels to be assembled and disassembled without disturbing the other reels of the row.

While various changes may be made in the detail construction, it shall be understood that such changes will be within the spirit and scope of the present invention as defined by the appended claims.

What is claimed is:

1. In a perforated panel board assembly, a panel board having spaced laterally-aligned peg holes therein, rod type brackets having spaced turned up legs hooked in said board peg holes and projecting forwardly from the panel board, each of said brackets having a horizontally—extending round rod portion, a rod adapter for each bracket having depending spring leg portions spaced apart and noramally converging upon one another to provide a middle attaching slot for receiving the horizontal rod portion in the mounting of the rod adapter upon the horizontal rod portion, the spacing of the adapter leg portions being slightly less that the diameter of the round rod portion so as to grip the rod portion and frictionally retain the adapter upon the rod portion of the bracket against free lateral and rotational displacement thereon and yet permitting restrained lateral and rotational adjustment for the affixing of other parts to the rod adapter while upon the rod bracket, each leg portion of the rod adapter having a vertically—extending attaching groove open at its top and closed at its bottom, and the groove of one adapter opposing groove of another adapter when the adapters are axially—aligned with one another in their spaced portions with their bracket upon the panel board, a rope or linear product reel having an end member with a central opening therein at end of the reel, a reel or spool adapter having a shank portion thrust into the central opening of each reel end member and a flanged head portion, the said head portions of reel adapters being accommodated within the opposing grooves of frictionally adjustable axially—aligned rod adapters from through their top openings, said reel end members being rotatable upon the shank portions of their reel brackets to permit free linear dispensing of the rope or like contents of the reel or spool, whereby one reel and its adapters can be individually lifted from the their axially—aligned reels without disassembling of the other reels from the row of axially-aligned reels so carried upon the panel board.

2. In a perforated panel board assembly as defined in claim 1, said shank portion of the reel adapter being of sheet-like form with edges and bifurcated at its end with spaced enlargements thereon, said shank portion being longer than the length of the end members for the enlargements to overrun the inner edge thereof and to allow or limited axial play of the reel adapters within the reel and for further accomodation in the assembly of the reel adapters and reel upon the frictionally adjustable rod adapter on the forwardly projecting rod bracket.

3. In a perforated panel board assembly as defined in claim 2 said sheet-like shank portion of the reel adapter having circumferentially-extended bearing surfaces pieces respective running along the respective edges of the shank portion to further facilitate the free rotation of the reel end members upon the reel adapter.

* * * * *